US008943763B2

(12) United States Patent
Lim

(10) Patent No.: US 8,943,763 B2
(45) Date of Patent: Feb. 3, 2015

(54) METHOD AND STRUCTURE FOR DAMPING MOVEMENT IN BUILDINGS

(75) Inventor: Koi Kee Lim, Chai Wan (HK)

(73) Assignee: VSL International AG, Koniz (CH)

( * ) Notice: Subject to any disclaimer, the term of this patent is extended or adjusted under 35 U.S.C. 154(b) by 74 days.

(21) Appl. No.: 13/392,230

(22) PCT Filed: Sep. 25, 2009

(86) PCT No.: PCT/EP2009/062434
§ 371 (c)(1),
(2), (4) Date: May 2, 2012

(87) PCT Pub. No.: WO2011/035809
PCT Pub. Date: Mar. 31, 2011

(65) Prior Publication Data

US 2012/0204509 A1 Aug. 16, 2012

(51) Int. Cl.
*E04H 9/02* (2006.01)

(52) U.S. Cl.
CPC ..... *E04H 9/021* (2013.01); *E04H 9/028* (2013.01)
USPC ..... 52/167.1; 52/396.04; 52/573.1; 52/741.3

(58) Field of Classification Search
USPC ..... 52/167.1–167.9, 396.04, 573.1, 741.3
See application file for complete search history.

(56) References Cited

U.S. PATENT DOCUMENTS

| | | | |
|---|---|---|---|
| 5,054,251 | A | 10/1991 | Kemeny |
| 5,215,382 | A | 6/1993 | Kemeny |
| 2008/0229684 | A1 | 9/2008 | Joung et al. |
| 2008/0307722 | A1 | 12/2008 | Christopoulos et al. |

FOREIGN PATENT DOCUMENTS

| | | | | |
|---|---|---|---|---|
| EP | 1544366 | A1 | 6/2005 | |
| WO | 2007045900 | A1 | 4/2007 | |
| WO | WO 2007/045900 | * | 4/2007 | ..... 52/167.1 |
| WO | WO 2007/048217 | * | 5/2007 | |

OTHER PUBLICATIONS

International Search Report dated Apr. 6, 2010.

* cited by examiner

*Primary Examiner* — William Gilbert
(74) *Attorney, Agent, or Firm* — Pearne & Gordon LLP

(57) ABSTRACT

Damping arrangement for low, medium and high-rise structures (1) using bidirectional damping means (5) such as visco-elastic Gensui damping devices, placed between two parallel elements of the structure (1), such as a core (2) and a perimeter column (3), or between two cores. Oscillatory or other flexural or shear deformations of the structure (1) are damped by damping axial movements between the two elements (2, 3), and simultaneously damping orthogonal movements between the two elements (2, 3). Outriggers (6, 7, 8) are used to enhance the axial damping moment, and the bidirectional damping means (5) may be installed in pairs, working in opposition to each other to damp dynamic shear or flexural forces in the orthogonal plane.

8 Claims, 11 Drawing Sheets

Figure 1A:
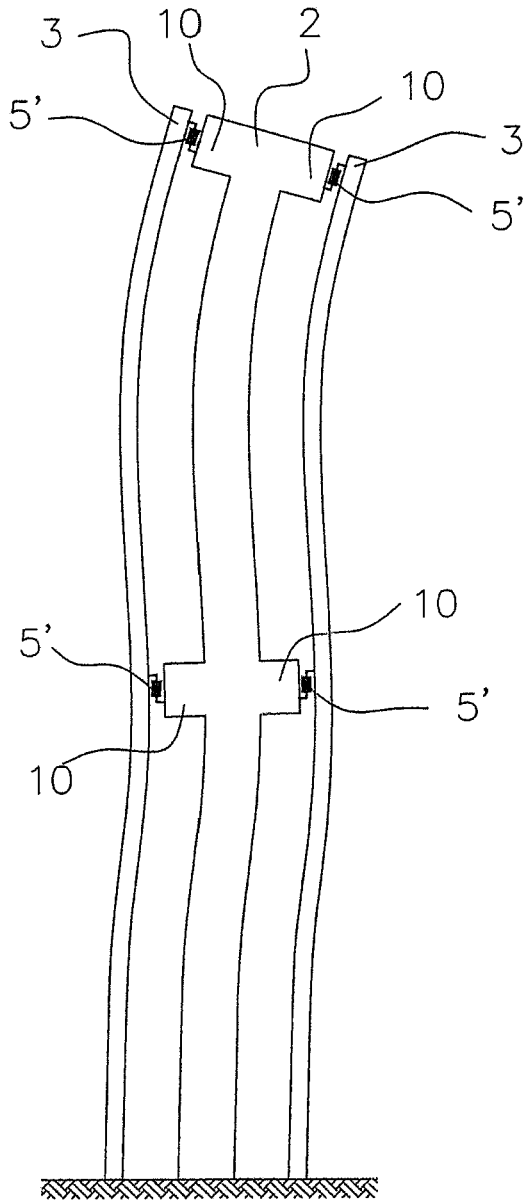

FIG. 6
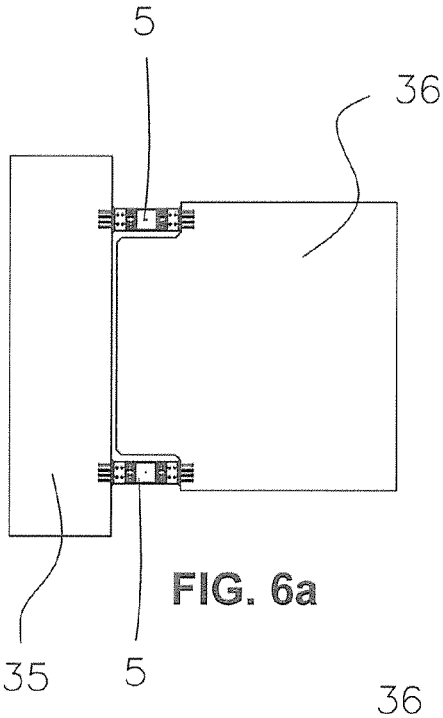
FIG. 6a
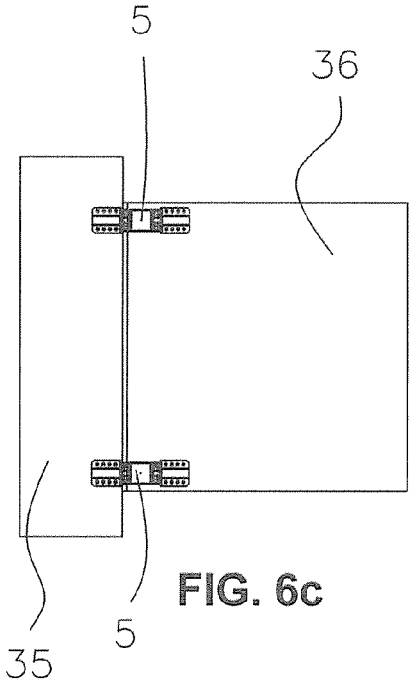
FIG. 6c
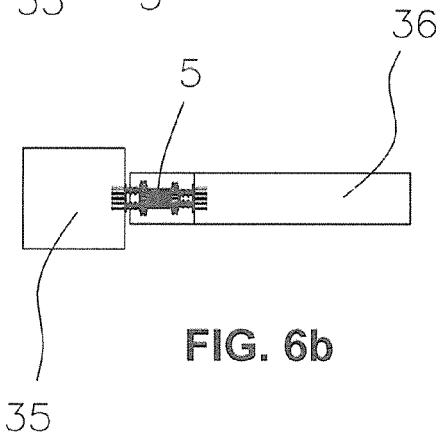
FIG. 6b
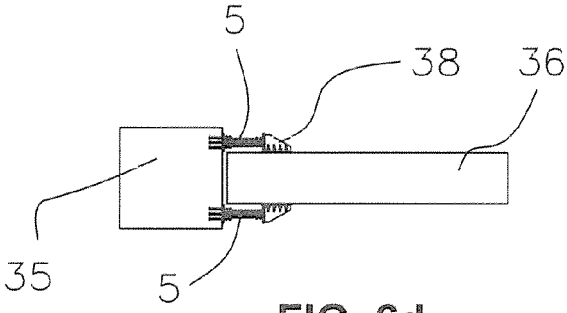
FIG. 6d
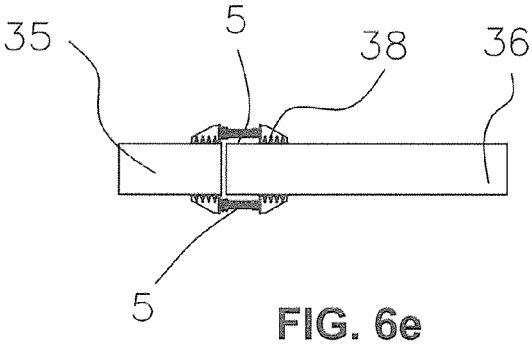
FIG. 6e FIG. 7
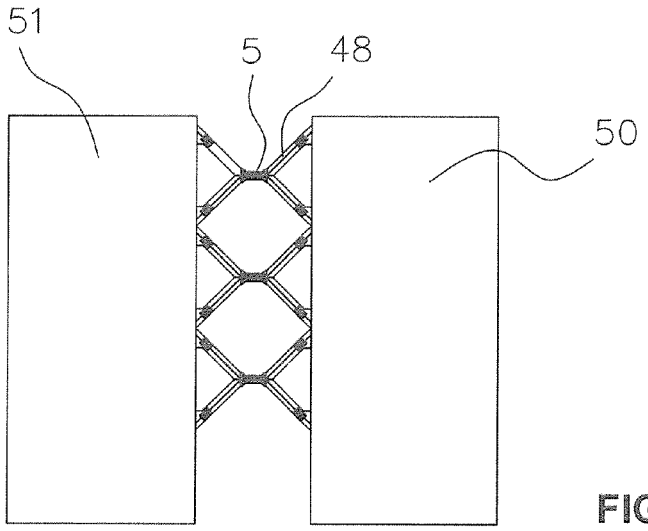
FIG. 7a
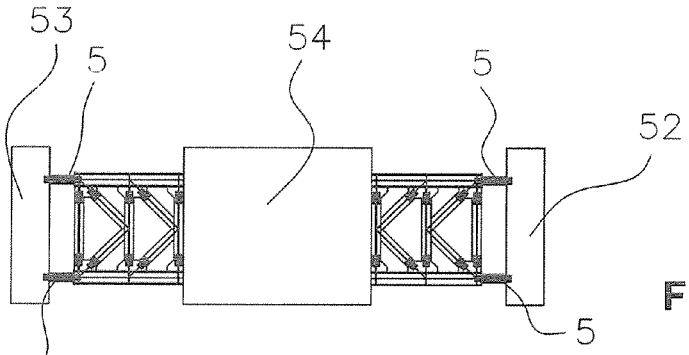
FIG. 7b
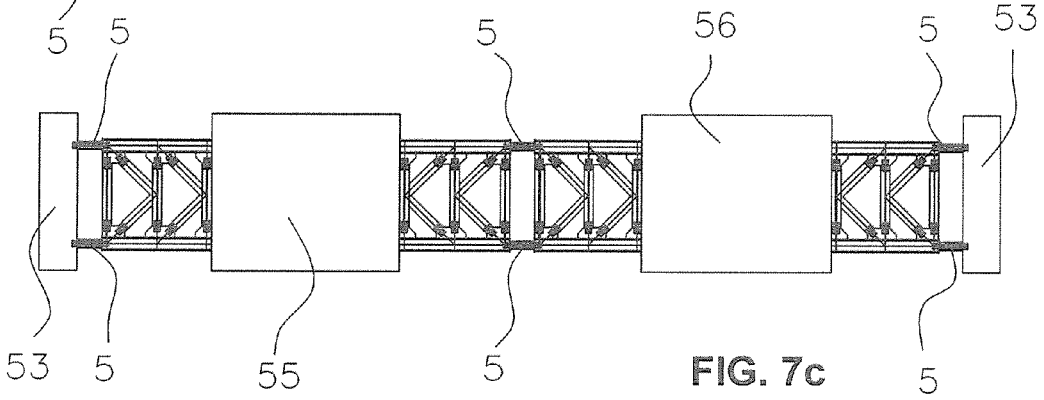
FIG. 7c

METHOD AND STRUCTURE FOR DAMPING MOVEMENT IN BUILDINGS

The invention relates to the damping of movements in building structures. In particular, it relates to the damping of oscillatory movements in a structural member by means of dampers connected to a second structural member.

Buildings, particularly high-rise structures, are designed to accommodate a certain amount of vibration, caused, for example, by the activities of the occupants, or by the movement of vehicles, and to withstand movement due to natural events such as wind gusts or earth tremors. It is common practice to design buildings whose structures include dampers to absorb and dissipate such movement. Damping the movement in a building not only provides better structural protection against potentially destructive earthquake or wind forces, it also makes the day-to-day occupancy of the building more pleasant. Swaying movements and oscillations in a building's structure are usually experienced as unpleasant sensations by the occupants. The damping reduces the magnitude and, to a certain extent, the velocity and acceleration of the movements of the building.

One such solution, for example, is to provide a so-called tuned mass damper (TMD) in the upper part of a structure. Tuned mass dampers may be implemented as one or more extremely massive blocks, moving in opposition to the resonant frequency of the oscillations of the structure. Alternatively, they may be implemented as sluice tanks containing liquid moving in opposition to the oscillations being damped. There are, however, major drawbacks with using tuned mass or sluice tank dampers. They are bulky and heavy, and need to be installed in the top of a building—traditionally the most lucrative space in the building. They represent a significant extra cost in a project, and do not offer any reduction in structural costs (indeed, the structure must be designed to support the additional weight of the tuned masses or sluice tanks, in addition to the bearings or other supporting mechanisms). TMDs must also be accurately tuned to the first mode of oscillation of the structure at the expense of damping other harmonics. Limit state calculations may be unreliable for TMDs, and it may be difficult or impossible to establish whether a TMD system will satisfy the ultimate limit state (ULS) for a building for wind gusting and earthquake. To satisfy the ULS, a building must not collapse when subjected to peak design loading and, since the effective operating range of TMDs is normally significantly narrower than ULS conditions, the behaviour of the TMD outside its operating conditions is unpredictable.

Another solution known in the prior art is the use of hysteretic dampers such as low-yield steel restraining braces, which can be used to give added damping and stiffness to the structural steel of a building. While they may be relatively inexpensive to fit, the damping function is only achieved when such braces actually yield, and they are not effective for small earthquakes or modest wind gusts. Because they are integral to the structure of a building, such braces are difficult and expensive to maintain and repair.

Base isolation dampers can be used to absorb vibrations at the base of a building. Such dampers have been available for many years, and their use is well established. In effect, a structure is mounted on its base on a number of damping elements which isolate movements of the building structure against movement in the ground. Base isolation dampers are an effective solution to earthquake movement, but they are costly to install, and are only suitable for relatively low buildings. Once installed, base isolation dampers are also extremely difficult and costly to replace. Base isolation dampers are not effective for wind-loading, because they are designed to be static (or with elastic deformation in the case of base isolators with springs) and do not provide any additional damping. For building vibration parallel to wind, building deformation is usually not in an oscillatory (+/−) mode. Furthermore, the use of base isolation dampers means that the building is mechanically isolated from its surroundings, so all cables, pipework and other services must have flexible connections to permit relative movement.

Viscous dampers, also known as hydraulic dampers, can be used for absorbing and dissipating oscillatory motion in a building. Hydraulic dampers have the advantage that they can absorb high loads during a large seismic event. However, they are expensive to install and expensive to maintain or replace, and replacement is particulary onerous if a unit fails. The movement of fluid between chambers inside a viscous damper is controlled by valves, and the aperture of these valves can be tuned to the required movement, either slow or fast. The viscous damper cannot, therefore, be tuned for both slow (low frequency such as wind) and fast (high frequency such as earthquake) movements.

A further disadvantage of hydraulic dampers is that they have no inbuilt redundancy—if a unit fails, then it ceases to function as a damper.

Visco-elastic dampers are used in bracing structures. They have the advantage that they are relatively low-cost, low-maintenance, and may be retro-fitted to existing buildings. Their visco-elastic behaviour also means that they can efficiently absorb oscillations at a broad range of frequencies, with the result that they do not require tuning to the extent required with other dampers.

For high buildings it is possible to dampen low-order oscillation modes of the structure by constructing the building with separate vertical members isolated from each other by dampers which absorb relative vertical movement between adjacent vertical members. Such an arrangement is disclosed, for example, in patent application Ser. No. WO2007045900 (ARUP), which describes a building having a core structure and several horizontal outrigger members connected via vertical dampers to perimeter columns. The vertical dampers are used to damp relative vertical displacement between the core (via the outriggers) and perimeter columns. A similar idea was subsequently disclosed in the patent application US2008/0229684 (Daewoo). The peripheral columns are stiff structures which provide a strong vertical structure against which the vertical dampers can exert a reaction in the up or down directions when the core undergoes flexural deformation.

In the prior art arrangements disclosed in WO2007045900 and US2008/0229684, the vertical dampers are mounted at points in approximately the top two-thirds of the height of the structure. The amount of relative vertical movement between the adjacent vertical elements is small in the lower part of the building, so the vertical dampers are mounted where the relative vertical movement is greater. However, the flexural deformation of a structure induced by, for example, earth tremors or wind gusts, is often a first, second or higher-order oscillation of the entire height of the building, so the vertical damping arrangement of the prior art only addresses a part of the flexing problem, and is only suitable for building above a certain height. Different types of damper would be required to damp lateral (horizontal) movements in the lower parts of the structure, or in less high buildings.

The objective of the present invention is to overcome the above disadvantages with the prior art damping systems. In particular, it is the aim of the invention to provide efficient damping for a structure, of any height, in such a way as to achieve improved damping of the whole structure, with a broad harmonic response (both amplitudes and frequencies), and with reduced installation and maintenance costs.

SUMMARY OF THE INVENTION

In order to achieve the above objectives, the invention proposes a building structure comprising a first structural element extending parallel to a vertical axis of the building structure, the first structural element being substantially self-supporting and susceptible of shear or flexural deformation, a component of the shear or flexural deformation being along a horizontal axis of the building structure, a second structural element, adjacent to the first structural element and extending parallel to the vertical axis, the first and second structural elements being such that the said shear or flexural deformation causes relative axial movements between the first and second structural elements parallel to said first axis at a first predetermined location along said vertical axis, and a plurality of vertically spaced damping stages, each damping stage comprising a rigid outrigger element extending outward from the first structural element towards the second structural element, the building structure being characterized in that it comprises a plurality of biaxial dampers, each capable of damping along at least two different axes, the dampers being arranged pairwise, in vertically spaced pairs along the vertical axis of the building structure, between the first and second structural elements, each pair of dampers comprising a first damper and a second damper arranged, vertically spaced, in a common region of the building structure, the first and second dampers being mounted between an outer part of each outrigger and the second structural element, so as to provide axial damping along the vertical axis and lateral damping along the horizontal axis, and such that, during said shear or flexural deformation of the first structural element in the common region of the building structure, the first damper is in one of tension or compression along one of its damping axes, while the second damper is in the other of tension or compression along one of its damping axes.

In one variant of the structure of the invention, the outrigger element is a wall of the building structure.

In another variant of the structure of the invention, at least one of the first and second dampers is a visco-elastic damping device.

In another variant of the structure of the invention, one of the first and second structural elements is a first core of the building structure and other of the first and second structural elements is either a perimeter column of the building structure or a second core of the building structure.

The invention also foresees a method of damping movements in a building structure comprising a first structural element extending parallel to a vertical axis of the building structure, the first structural element being substantially self-supporting and susceptible to shear or flexural deformation, a component of the shear or flexural deformation being along a horizontal axis of the building structure, the method comprising:

a first step of providing a second structural element adjacent to the first structural element, and extending parallel to the vertical axis, the first and second structural elements being such that the said shear or flexural deformation causes relative axial movements between the first and second structural elements parallel to said first axis at a first predetermined location along said vertical axis, a second step of arranging a plurality of vertically spaced damping stages, each damping stage comprising a rigid outrigger element extending outward from the first structural element towards the second structural element, the second step including arranging a plurality of biaxial or multiaxial dampers pairwise, in vertically spaced pairs along the vertical axis of the building structure, between the first and second structural elements, each pair of dampers comprising a first damper and a second damper arranged, vertically spaced, in a common region of the building structure, the first and second dampers being mounted between an outer edge of each outrigger and the second structural element, so as to provide axial damping along the vertical axis and lateral damping along the horizontal axis, and such that, during said shear or flexural deformation of the first structural element in the common region of the building structure, the first damper is in one of tension or compression along one of its damping axes, while the second damper is in the other of tension or compression along one of its damping axes.

The first and second structural elements may be, for example, a core of a building and a peripheral column. Such columns can be integral to a building, or they can be external to the building. Alternatively, the first and second elements may be two adjacent core structures of a single building, or even adjacent buildings.

The relative horizontal movements which are to be damped are advantageously movements of the first and second elements towards and away from each other. Note that in this description a Z axis is defined as being the vertical axis of a structure or building, parallel to the first and second elements, while the X and Y axes, substantially orthogonal to one another, lie in a substantially horizontal plane, orthogonal to the Z axis. In the case of a building of rectangular cross-section, the X and Y axes can be assumed to lie substantially parallel to the length and the width of the building's cross-section respectively. Thus, in this embodiment, the first damper is arranged to damp movements in the Z direction as well as in one direction in the horizontal plane, namely along a first horizontal axis, parallel to the X or Y axis, at the first predetermined location along the first axis. In this embodiment, this second axis is preferably the direction of motion of the first and second structural elements towards and away from each other, or at least the movement of the parts of the first and second structural elements at the first predetermined location.

The first and second structural elements are preferably substantially stiff structures, and the first and second damping means act as a pair, opposing any forces (such as shear or flexural forces) which would tend to move the first and second element out of their mutually parallel alignment. Both dampers also provide a damped reaction opposing relative axial forces or movements (along the vertical axis in the case of vertical structural elements).

The use of pairs of dampers, each damper providing independent damping along an axis parallel to the first horizontal axis, with the dampers being mounted vertically spaced at the end of outrigger elements, gives a greatly enhanced damping of the shear or flexural forces and movements in the vertical structure. The outrigger element also offers increased moment for vertical damping forces.

The damper or dampers are advantageously bi-axial or multi-axial visco-elastic dampers. Such dampers which may comprise one or more pairs of rigid (for example metal) plates, each pair of plates being separated by a sheet of visco-elastic material such as highly engineered rubber. Such dampers offer broad-response damping in all directions parallel to the plane of the plates and sheets. Particularly advantageous for the invention is the use of such plate/sheet dampers in which the visco-elastic material has a substantially rectangular or elliptical section, such that it has two principal damping axes. The two principal damping axes can then be arranged to coincide with the desired Z and X/Y axes of the building being damped.

Advantageously, the outrigger element may be of a strut and tie construction to reduce weight while retaining stiffness and strength in the structure. Alternatively, the outrigger element may be implemented as a wall of the building structure—an internal wall extending outward from a load-bearing core, for example.

The method of the invention may be applied to many kinds of structures. It is particularly advantageous when the structure is a building, with the first element being a core of the building and the second element being a perimeter column of the building. The method of the invention may also be advantageously used in buildings in which the first vertically extending structural element is a first core of the building and the second vertically extending structural element is a second core of the building.

Alternatively, the invention can be used to damp vertical movements, such as oscillations, in horizontal structural elements such as cantilever floors or beams.

According to the method and structure of the invention, therefore, the same type of damping elements can be used for damping the top, middle and bottom sections of the building, and the damping elements can be used for damping motion on all kinds of buildings. The use of bi-axial visco-elastic dampers, such as VSL's GENSUI™ dampers, means reduced cost and improved ease of maintenance. Because of their compact size and easy mounting, such dampers can also readily be retro-fitted to existing structures.

Because of the versatility of the bi-directional visco-elastic damper, the method and structure of the invention are suitable not only for high-rise buildings, but for all kinds of structures including low-rise constructions, houses, bridges and many others.

Further advantages of the invention will become apparent from the following detailed description and figures.

Figure 1B:
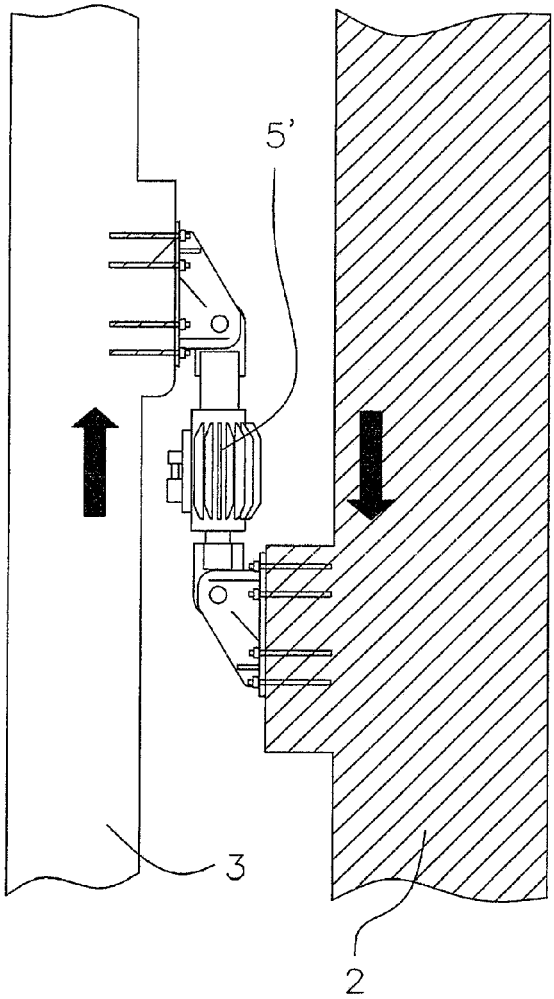
Figure 1C:
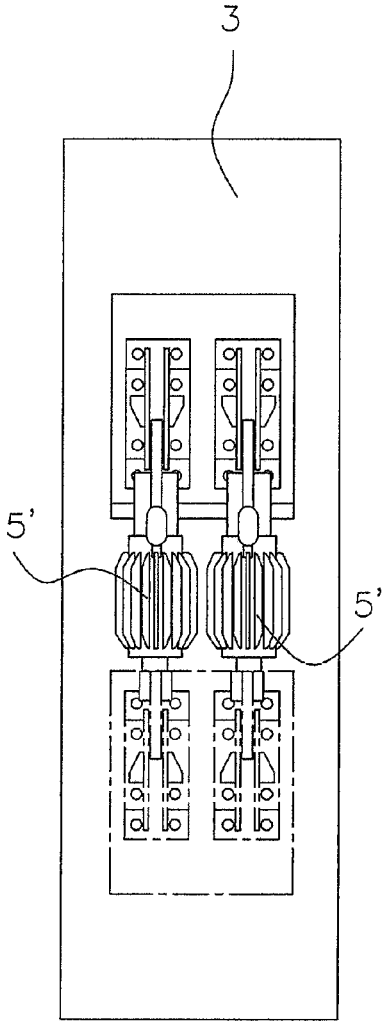

FIGS. 1*a* to 1*c* shows a prior art arrangement of hydraulic dampers.

FIGS. 2*a* to 2*d* illustrate the general principle of the invention.

Figure 3A:
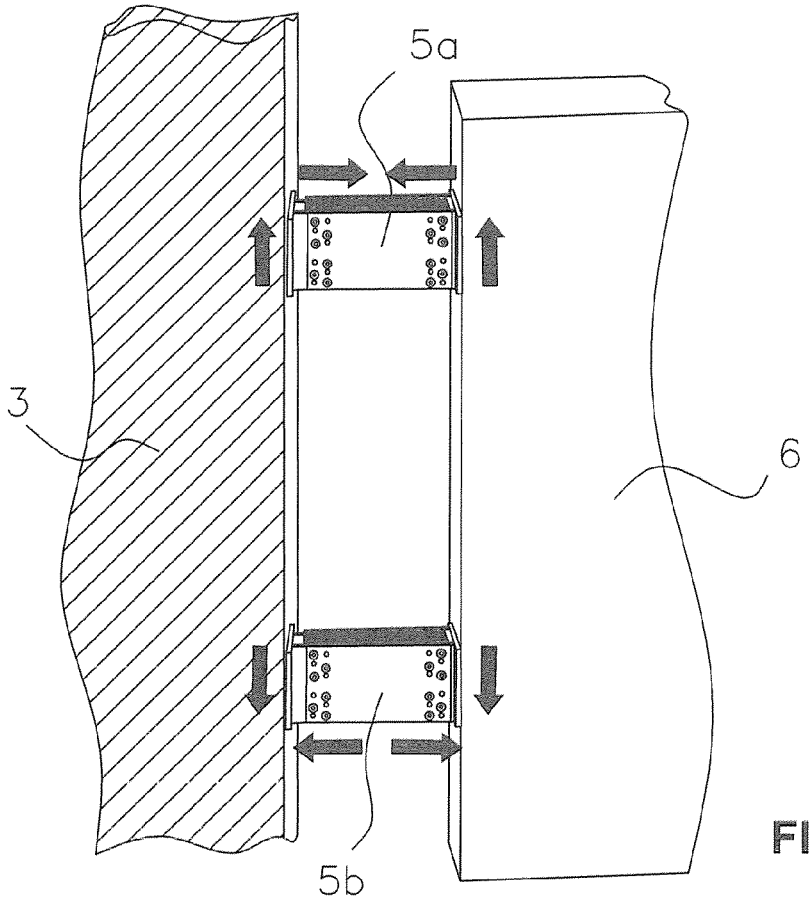
Figure 3B:
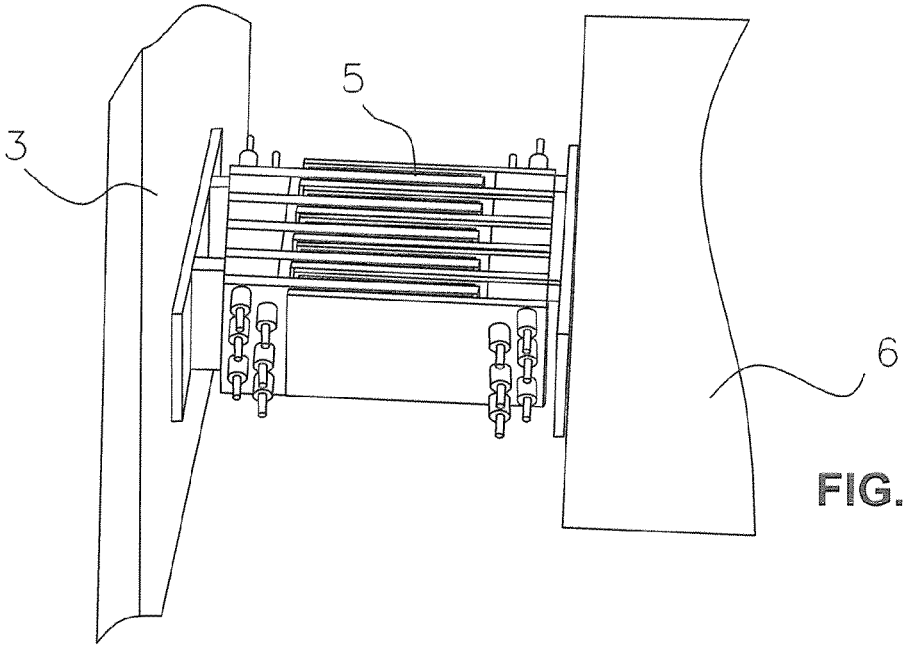

FIGS. 3*a* and 3*b* illustrate how a visco-elastic damper may be arranged between two vertical structures to damp movement between them.

Figure 4A:
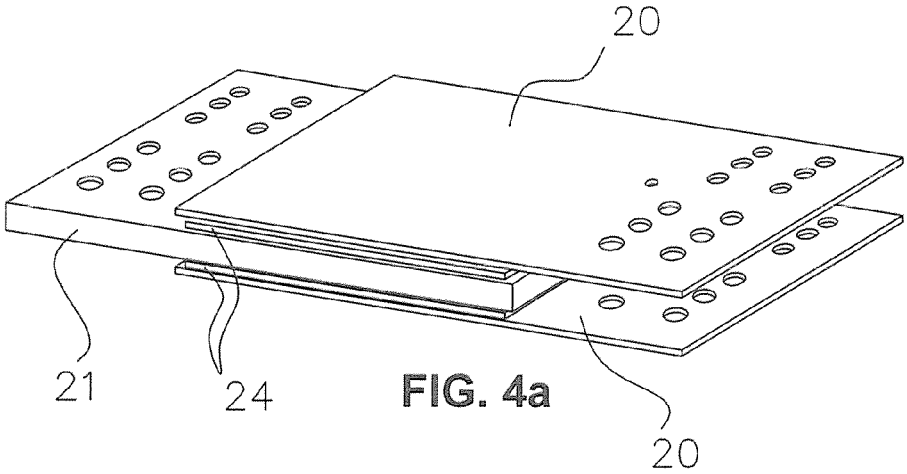
Figure 4B:
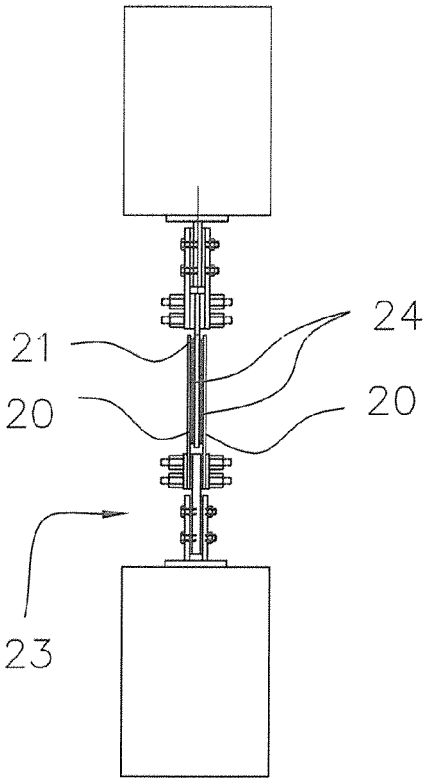
Figure 4C:
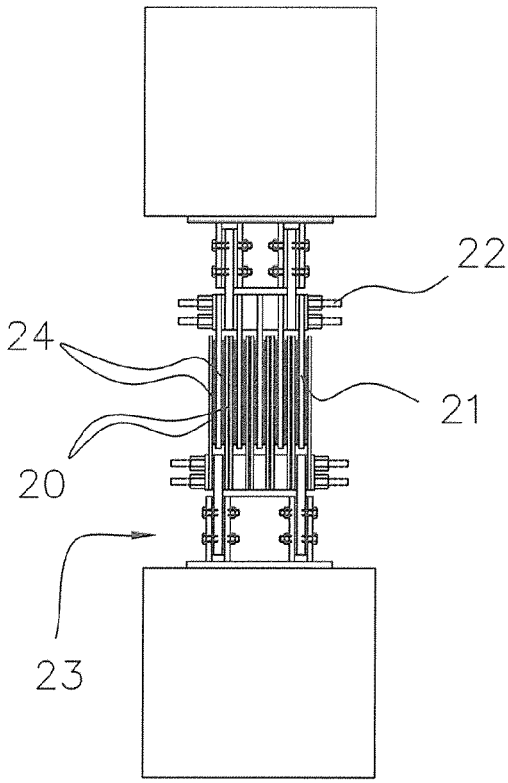

FIGS. 4*a* to 4*c* show a schematic view of a bi-axial visco-elastic damper.

FIGS. 5*a* to 5*e* show the application of the invention to a high-rise building.

FIGS. 6*a* to 6*e* show a space-saving variant of the invention

FIGS. 7*a* to 7*c* show various example configurations of the invention.

The figures are included for illustrative purposes only, and are intended to aid understanding of the invention without implying any limitation of the scope of the accompanying claims.

The general principle of damping flexural deformation motion by damping the vertical movement between adjacent vertical structures can be understood with reference to FIG. 1*a*, which represents in greatly exaggerated, schematic form an elevation view of a building undergoing oscillatory deformation. The building in the illustrated example comprises a central core structure 2, which might for example be the main static load-bearing structure, and two external columns 3. As with the prior art systems mentioned earlier in this application, damping of the oscillatory motion can be achieved by means of vertical dampers 5' mounted between the core 2 and the columns 3 at various points along the height of the structure, so as to damp relative vertical movement between the core 2 and the columns 3. Outriggers 10 may be used as cantilevers to give extra moment to the damping forces. The columns 3 are capable of withstanding the vertical dynamic tension and compression reactions transferred to them by the vertical dampers from the core 2 when it flexes. In this way, a significant proportion of the kinetic energy in the flexural and oscillatory motion of the core 2 can be dissipated in the vertical dampers 5'.

FIGS. 1*b* and 1*c* show, in side and front elevations, more detail of a typical vertical damping arrangement of the prior art. Uni-axial dampers 5', which may be hydraulic dampers, although other kinds of dampers may also be used, are mounted between the perimeter column 3 and the core 2, so as to damp movements parallel to the core and column, as indicated by the arrows shown in FIG. 1*b*.

Figure 2A:
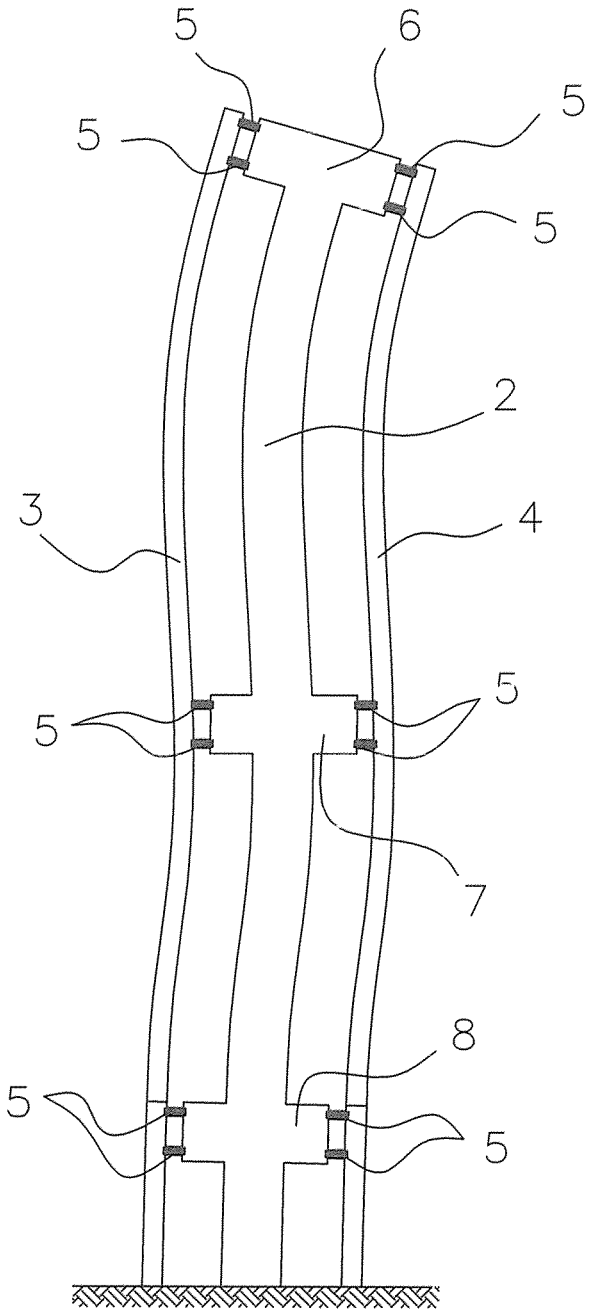

By contrast, the dampers 5 used in the method and structure of the invention are bi-axial dampers capable of damping along at least two different axes, as shown in FIGS. 2*a* to 2*d*. The structure 1 illustrated in FIG. 2*a* is shown with three successive damping stages at different heights on the structure. Of course, such a structure could be equipped with as many damping stages as necessary. The top-most damping stage comprises an outrigger 6 for providing rigid mechanical extension of the core 2 outwards towards the peripheral columns 3. In a high-rise building, such an outrigger may extend vertically the height of one storey or more, for example.

The embodiment of the invention illustrated in FIGS. 2*a* to 2*d* has vertically spaced pairs of biaxial dampers 5, 5*a*, 5*b* mounted at each end of an outrigger 6, 7, 8 between the outrigger 6, 7, 8 and the column 3. Each pair of dampers 5*a*, 5*b* provides damping not only in a vertical direction (along a vertical axis parallel to the core 2 and to the column 3), but also along mutually parallel horizontal axes, the horizontal axes being substantially parallel to the outrigger 6, 7, 8 and orthogonal to the vertical axis.

The pairwise, vertically-spaced arrangement of the dampers 5*a*, 5*b*, together with the stiffness of the columns 3, introduces a secondary damping effect in addition to the vertical and horizontal damping provided by each damper 5 individually. This effect can be seen in FIG. 2*c*, for example: in addition to the vertical displacement, which is damped by the shear deformation of dampers 5*a* and 5*b*, a lateral displacement of the outrigger 7 relative to the column 3 will give rise to an imbalance in horizontal forces on the dampers 5*a* and 5*b*. If, for example, the outrigger 7 moves to the right (as viewed in FIG. 2*c*) while remaining horizontal, the column, by virtue of its innate stiffness, resists being deformed, with the result that the upper damper 5*a* of the pair is subject to compressive forces C, while the lower damper 5*b* is subject to horizontal tension forces T. Thus, the stiffness of the column, together with the visco-elastic behaviour of the dampers 5*a* and 5*b*, provides an extra, secondary, damping effect on the horizontal motion of the outrigger 7 relative to the column 3. The columns 3 are constructed to be stiff enough to provide the required resistance to shear deformation via the pairs of dampers 5*a*, 5*b*, and the vertical spacing of the dampers 5*a* and 5*b* is chosen to provide optimum damping for the anticipated movements. Note also that a similar damping effect occurs if the outrigger 7 undergoes a tilting or rotational movement relative to the column 3.

Figure 2B:
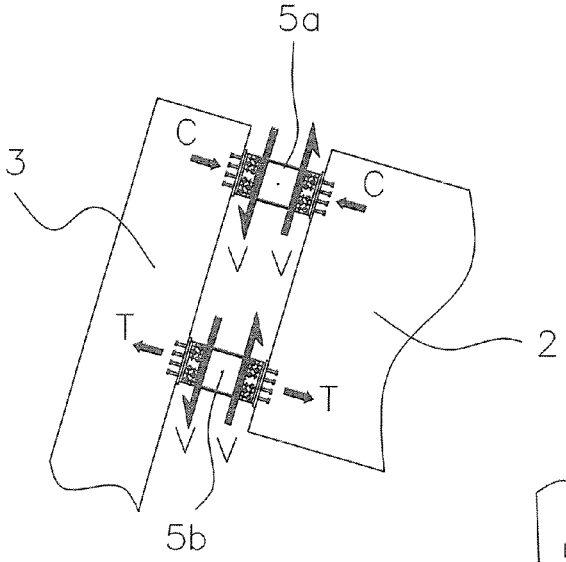
Figure 2C:
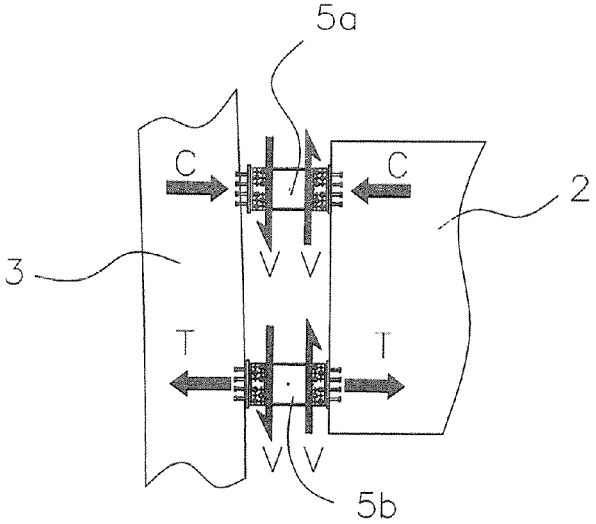
Figure 2D:
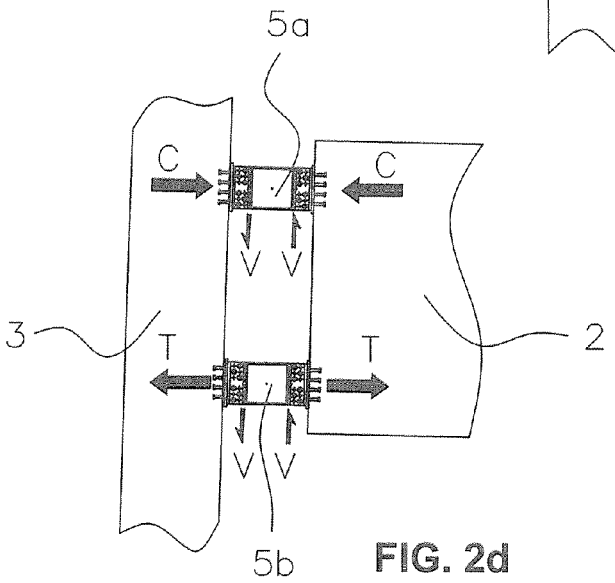

The characteristics of the dynamic forces and deformations are normally different at different heights on the building 1, and three different instances of the pairwise damping are shown in FIGS. 2*b*, 2*c* and 2*d*. The relative sizes and directions of the arrows in FIGS. 2*b* to 2*d* represent the size and orientation of the forces and/or displacements concerned, and are therefore indicative of the amount of damping which is expected during flexing or shear deformation of the structure 1.

FIG. 2*b* shows damping at or near the top of the building 1 where the flexural deformation of the core 2 and the columns 3 usually gives rise to the greatest relative vertical displacement between the core 2, via the outrigger 6 and each column 3. This large relative vertical displacement causes a large vertical shear deformation V in both of the dampers 5*a* and 5*b*, illustrated in FIG. 2*b*. By comparison, the relative horizontal or torsional shear deformation of the core 2 relative to the column 3 is relatively modest, with the result that the compression C and tension T in dampers 5*a* and 5*b* would be smaller than the vertical shear forces occasioned by the flexural deformations of the structure 1.

FIG. 2*c* shows damping at a mid-point on the height of the structure 1, at which point the shear forces on the dampers 5*a* and 5*b* due to relative vertical displacement of the column 3 and the outrigger 7 may be comparable to the opposed horizontal compression C and tension T forces in the dampers 5*a* and 5*b*, respectively.

FIG. 2*d* shows damping at a point lower down the building 1, where the vertical movement between core 2 and column 3, via outrigger 8, is less pronounced. A shear deformation of the structure 1 at this height engenders horizontal forces of compression C and tension T in the dampers 5*a* and 5*b* which may be significantly greater in magnitude than the shear forces V due to vertical movement.

By using bidirectional, super-high damping visco-elastic dampers such as the GENSUI™ dampers from VSL, it is possible to damp the vertical and the horizontal components of the deformations at the same time, using the same damper. These dampers exhibit bi-linear hysteresis and high damping and stiffness properties in at least two directions. They offer vibration control within a wide frequency range. They are effective for all zones and types of buildings. They are maintenance-free, highly durable, and their damping characteristics are largely independent of strain ratio, temperature and vibration frequency. Multi-unit devices also offer significant redundancy; in the event that a device did start to fail, it would fail gradually, suffering increasingly degraded performance, in contrast to the sudden complete failure seen, for example, in hydraulic dampers.

The application of such dampers is illustrated in FIGS. 3*a* and 3*b*. FIG. 3*b* shows in close-up a multi-layered GENSUI™ damper mounted between the column 3 and and outrigger 6. The damper 5, as will be discussed shortly, comprises multiple layers of a visco-elastic rubber-like substance, each layer being sandwiched between steel plates. FIG. 3*a* shows two such dampers 5*a* and 5*b* mounted at the end of an outrigger 6, as shown in FIGS. 2*a* to 2*d*. Arrows indicate the dynamic loading to which the dampers are subjected.

FIGS. 4*a* to 4*c* show in more detail how a visco-elastic damper, such as the GENSUI™ dampers from VSL, may be constructed. FIG. 4*a* illustrates the basic concept of such a damper: steel plates 20, and 21 (which could alternatively be fabricated in other rigid materials) enclose two layers 24 of visco-elastic material such as rubber. Plates 20 are bolted to a first structure, plate 21 to a second, with the result that any relative movement of the two structures in the plane of the damper can be damped by the damper—any combination of shear, rotation or translation in the plane. Note that spacers are usually provided between the plates 20 so that the mounting bolts 22 can be tightened without crushing or otherwise distorting the visco-elastic material 24 between the plates. Brackets 23 are used to mount the damper units to the construction being damped. FIGS. 4*a* and 4*b* show a single unit damper in perspective and elevation views, respectively. FIG. 4*c* shows in elevation view a multi-unit damper. The visco-elastic material used in such dampers is usually a highly engineered type of natural or synthetic rubber or rubber composite, although a variety of materials can be used.

Figure 5A:
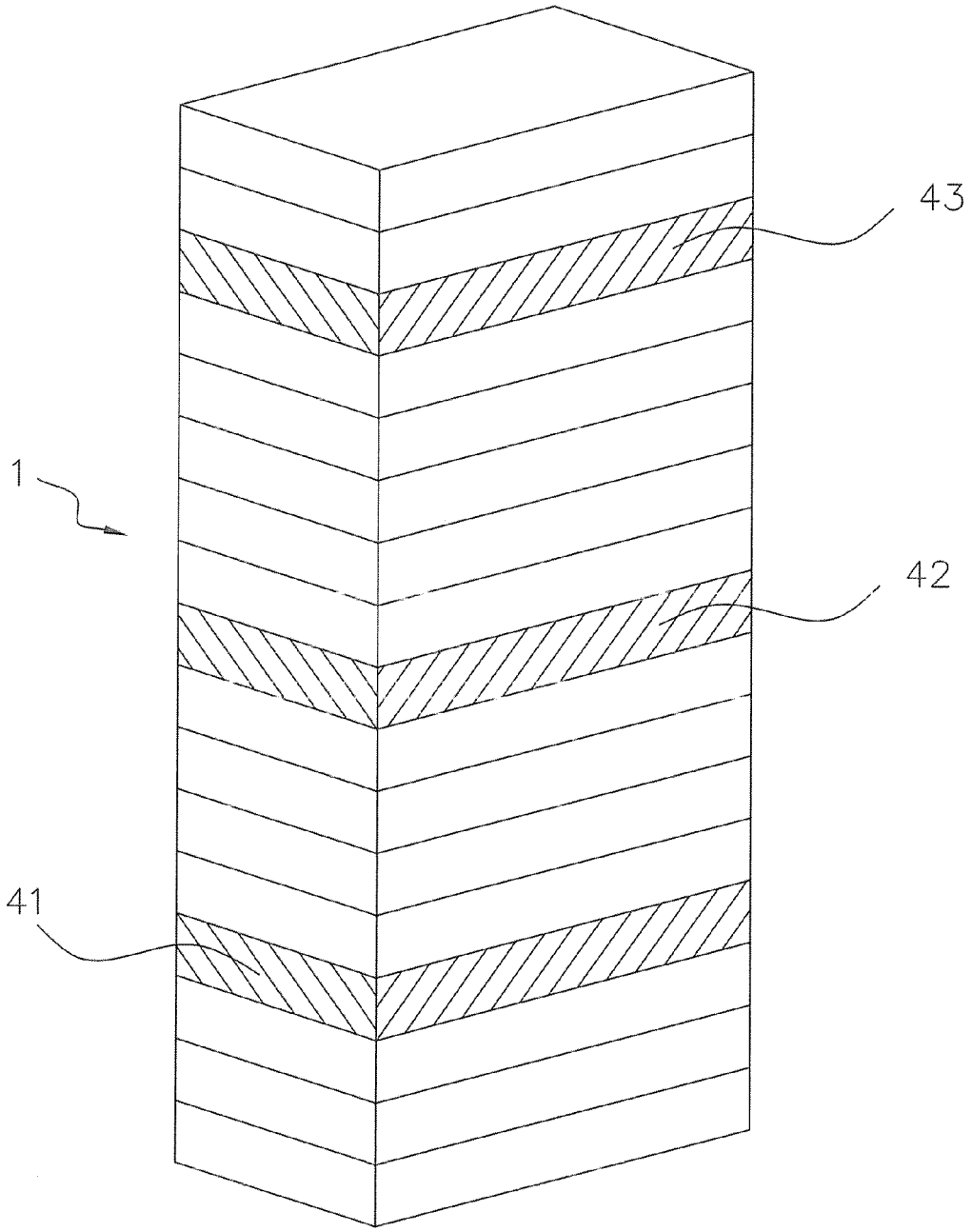
Figure 5B:
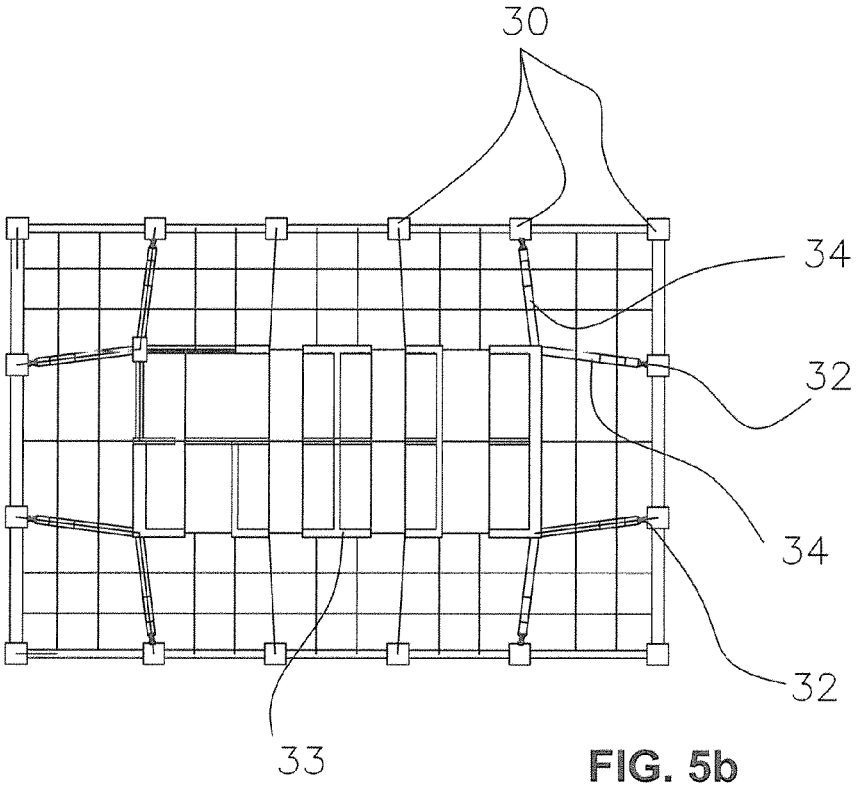
Figure 5C:
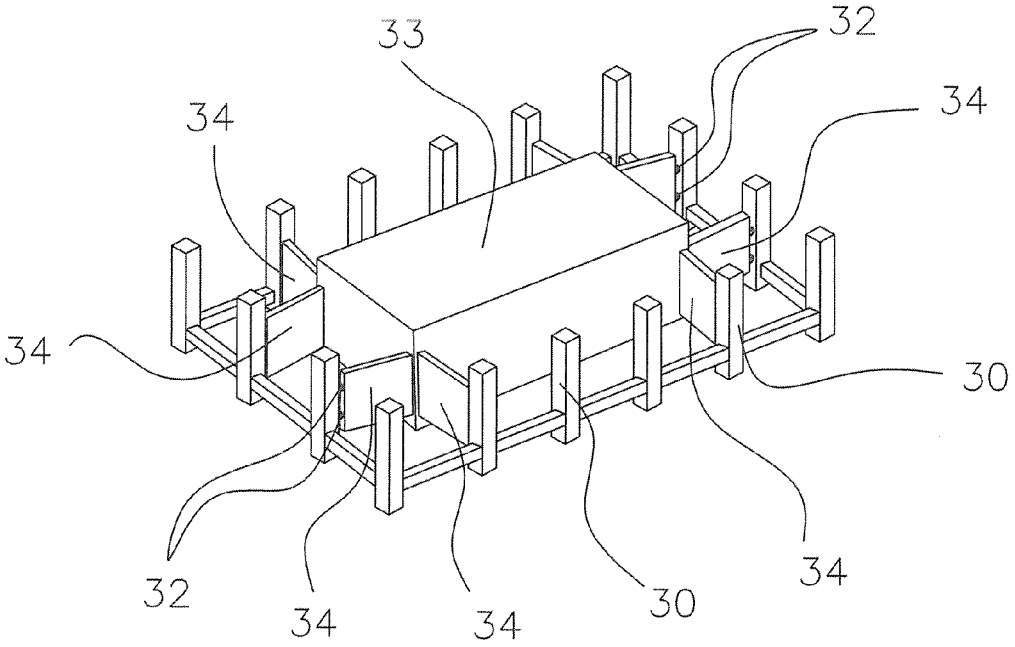

FIGS. 5*a* to 5*c* show an example of how the damping method of the invention can be applied to a high-rise building. In the example shown, damping is provided at three floors of the building, labeled 41, 42 and 43 in FIG. 5*a*. The choice of number of floors is dependent on the structure to be damped—for some structures, more floors may require damping, for others just one or two. FIGS. 5*b* and 5*c* show in plan and perspective view the outrigger walls 31 between the core structure 33 and the columns 30. The dampers 32 are positioned in pairs near the top and bottom of the outside edge of each wing-wall outrigger 31. One advantage of providing the dampers 32 at the top and at the bottom of the outrigger 31 is that the adjacent floor slab (above or below, respectively) gives the outrigger 31 additional strength, and also helps to prevent the wing wall from buckling due to compression.

When retrofitting outriggers and dampers to existing structures, the outrigger wing wall or truss can be realized by locally thickening, or otherwise strengthening, an existing wall or truss of the structure.

Figure 5D:
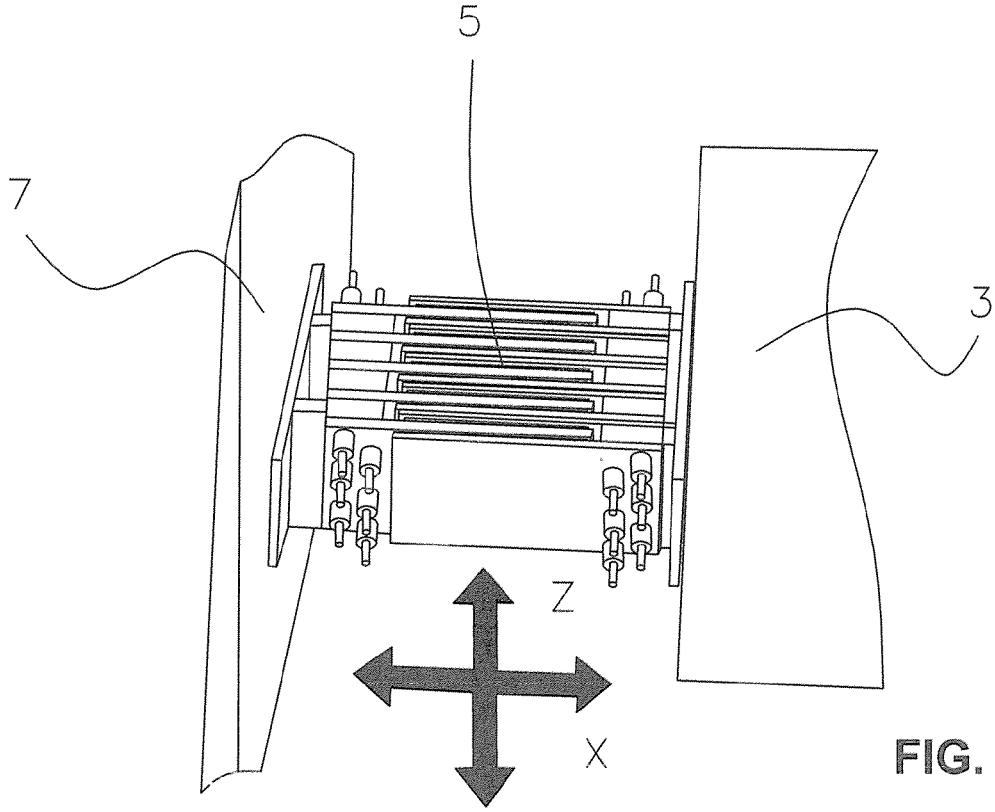
Figure 5E:
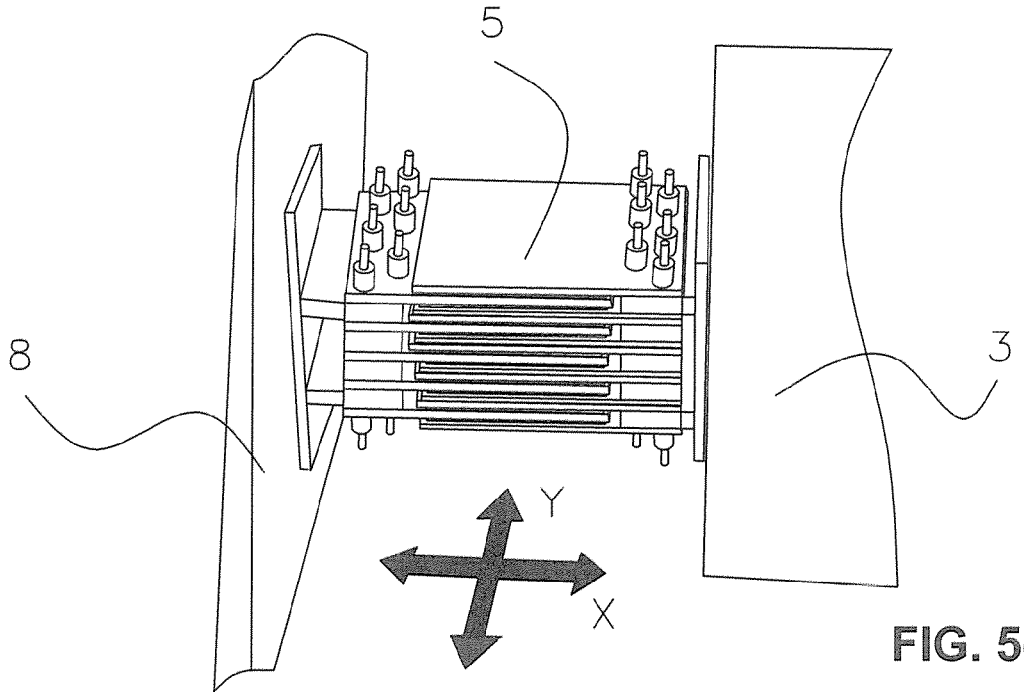

In the example shown in FIGS. 5*a* to 5*c*, the dampers 32 are arranged, as described in FIG. 5*d*, to damp movements in the Z and X directions or the Z and Y directions, depending on which side of the building they are (i.e. along the vertical axis and along a horizontal axis running through the column and the core). This can be the case on all the floors which are damped. Alternatively, for damping in the lower part of the building, where the vertical component of the deformations is much smaller, the bidirectional dampers 5 can be mounted such that they damp in the X and Y directions, as indicated in FIG. 5*e*. In this manner, the extra damping of shear and flexural deformation of the structure is maintained, thanks to the pairwise mounting of the vertically separated dampers, but there is also a greatly improved damping of oscillatory or other movements in both the X and the Y axes in the horizontal plane.

FIGS. 6*a* to 6*e* show, in schematic form, plan and elevation views of two ways in which an outrigger can be designed to use the damping arrangement of the invention, while optimizing the amount of space required for the dampers themselves. FIGS. 6*a* and 6*b* show, in side elevation and plan view respectively, how the bidirectional dampers 5 can be recessed neatly into the outrigger 36, which may be a wall of the building being damped. Only a small gap is therefore necessary between the outrigger 36 and the perimeter column 35, leaving almost the entire space between outriggers, and between the core and the perimeter columns, available for use by the occupants of the building. FIGS. 6*c* to 6*e* show an alternative space-optimising arrangement in which, instead of being recessed into the outrigger wall 36, the dampers 5 are fixed to the sides of the outriggers 36 using brackets 38. Depending on the geometry of the perimeter column, the dampers 5 may be bolted to the inner face of the column, as in FIG. 6*d*, or by using brackets 38 similar to those used to fix the dampers to the outrigger wall.

FIGS. 7*a* to 7*c* show in plan view, various examples of construction configurations using the present invention. In FIG. 7*a*, two vertical core structures 50 and 51 are inter-damped using bidirectional dampers, with the damping being carried out between two bracing structures 48, which function as outriggers to enhance the damping moment and, when the dampers 5 are fitted in vertical pairs according to one embodiment of the invention, to provide the stiffness required for the secondary damping of horizontal shear forces mentioned earlier in this description.

FIG. 7*b* shows a core 54 and two adjacent columns 52 and 53, with a strut-and-tie type outrigger constructed of braced strutwork, the damping units 5 being mounted between the strutwork and the columns 52, 53. FIG. 7*c* illustrates how the configuration of FIG. 7*b* can be altered or extended to a structure having two or more cores: bidirectional dampers 5 can be fitted between the cores 55, 56, or between one of the cores and a perimeter column, or both.

The invention claimed is:

1. A building structure comprising:

a first structural element extending parallel to a vertical axis of the building structure, the first structural element being substantially self-supporting and susceptible of shear or flexural deformation, a component of the shear or flexural deformation being along a horizontal axis of the building structure, a second structural element, adjacent to the first structural element and extending parallel to the vertical axis, the first and second structural elements being such that a component of said shear or flexural deformation causes relative axial movements between the first and second structural elements parallel to said vertical axis at a first predetermined location along said vertical axis, a plurality of vertically spaced damping stages, each damping stage comprising a rigid outrigger element extending outward from the first structural element towards the second structural element, a plurality of biaxial or multiaxial dampers, each damper capable of damping along a first damping axis substantially parallel to said vertical axis and a second damping axis perpendicular to said first damping axis, the dampers being arranged pairwise, in vertically spaced pairs along said vertical axis, between the first and second structural elements, each pair of dampers comprising a first damper and a second damper arranged, vertically spaced, in a common region of the building structure, the first and second dampers being mounted between an outer part of each outrigger and the second structural element, so as to provide axial damping along said vertical axis and lateral damping along said horizontal axis, and such that, during said shear or flexural deformation of the first structural element in the common region of the building structure, the first damper is in one of tension (T) or compression (C) along one of its damping axes, while the second damper is in the other of tension (T) or compression (C) along one of its damping axes.

2. The building structure of claim 1, in which the outrigger element is a wall of the building structure.

3. The building structure of claim 1, in which at least one of the first and second dampers is a visco-elastic damping device.

4. The building structure of claim 1, in which one of the first and second structural elements is a first core of the building structure and other of the first and second structural elements is either a perimeter column of the building structure or a second core of the building structure.

5. A building structure comprising:

a first structural element extending parallel to a vertical axis of the building structure, the first structural element being substantially self-supporting and susceptible of shear or flexural deformation, a component of the shear or flexural deformation being along a horizontal axis of the building structure, a second structural element, adjacent to the first structural element and extending parallel to the vertical axis, the first and second structural elements being such that a component of said shear or flexural deformation causes relative axial movements between the first and second structural elements parallel to said vertical axis, a plurality of vertically spaced damping stages, each damping stage comprising a rigid outrigger element extending between the first and second structural elements, a plurality of biaxial or multiaxial dampers mounted pairwise, in vertically spaced pairs along said vertical axis, each pair mounted between the first and second structural elements and to a respective one of said outrigger elements, each pair of dampers comprising a first damper and a second damper arranged, vertically spaced, in a common region of the building structure, wherein each said damper is capable of providing axial damping along a first damping axis substantially parallel to said vertical axis and lateral damping along a second damping axis substantially parallel to a direction in which said outrigger element extends, and such that, during said shear or flexural deformation of the first structural element in the common region of the building structure, the first damper is in one of tension (T) or compression (C) along one of its damping axes, while the second damper is in the other of tension (T) or compression (C) along one of its damping axes.

6. Method of damping movements in a building structure comprising a first structural element extending parallel to a vertical axis of the building structure, the first structural element being substantially self-supporting and susceptible to shear or flexural deformation, a component of the shear or flexural deformation being along a horizontal axis of the building structure, the method comprising:

a first step of providing a second structural element adjacent to the first structural element, and extending parallel to said vertical axis, the first and second structural elements being such that a component of said shear or flexural deformation causes relative axial movements between the first and second structural elements parallel to said vertical axis at a first predetermined location along said vertical axis, a second step of arranging a plurality of vertically spaced damping stages, each damping stage comprising a rigid outrigger element extending outward from the first structural element towards the second structural element, wherein the second step includes arranging a plurality of biaxial or multiaxial dampers pairwise, in vertically spaced pairs along said vertical axis, between the first and second structural elements, each of said dampers being capable of damping along a first damping axis substantially parallel to said vertical axis and a second damping axis perpendicular to said first damping axis, each pair of dampers comprising a first damper and a second damper arranged, vertically spaced, in a common region of the building structure, the first and second dampers being mounted between an outer edge of each outrigger and the second structural element, so as to provide axial damping along said vertical axis and lateral damping along said horizontal axis, and such that, during said shear or flexural deformation of the first structural element in the common region of the building structure, the first damper is in one of tension (T) or compression (C) along one of its damping axes, while the second damper is in the other of tension (T) or compression (C) along one of its damping axes.

7. The method of claim 6, in which the first and/or second dampers are visco-elastic damping devices.

8. The method of claim 6, in which one of the first and second structural elements is a first core of the building structure and other of the first and second structural elements is either a perimeter column of the building structure or a second core of the building structure.

* * * * *